US006371040B1

(12) United States Patent
Hemphill et al.

(10) Patent No.: US 6,371,040 B1
(45) Date of Patent: Apr. 16, 2002

(54) COMBINED FOAM AND INFLATABLE COLLAR ASSEMBLIES FOR WATERCRAFT

(75) Inventors: Douglas H. Hemphill; Gary Dale, both of Delta (CA)

(73) Assignee: Zodiac Hurricane Technologies, Inc., Delta (CA)

( * ) Notice: Subject to any disclaimer, the term of this patent is extended or adjusted under 35 U.S.C. 154(b) by 0 days.

(21) Appl. No.: 09/685,290

(22) Filed: Oct. 10, 2000

Related U.S. Application Data

(60) Provisional application No. 60/186,305, filed on Mar. 2, 2000.

(51) Int. Cl.[7] ..... B63B 59/02
(52) U.S. Cl. ..... 114/219; 114/123
(58) Field of Search ..... 114/345, 357, 114/68, 69, 123, 219; 441/129

(56) References Cited

U.S. PATENT DOCUMENTS

| | | | | |
|---|---|---|---|---|
| 2,919,451 A | | 1/1960 | Long | |
| 3,121,888 A | | 2/1964 | Morgan et al. | |
| 3,596,622 A | * | 8/1971 | Moore | 114/69 |
| 3,964,422 A | | 6/1976 | Boyd | |
| 4,060,865 A | | 12/1977 | Woolworth | |
| 4,287,624 A | | 9/1981 | Lowther | |
| 4,296,705 A | | 10/1981 | Uruta et al. | |
| 4,520,746 A | * | 6/1985 | Walters et al. | 114/69 |
| 4,628,850 A | | 12/1986 | Day et al. | |
| 4,817,555 A | | 4/1989 | Meinen | |
| D308,042 S | | 5/1990 | Kitner et al. | |
| 4,928,619 A | * | 5/1990 | Cochran | 114/345 |
| 4,996,936 A | | 3/1991 | Brundritt | |
| 5,269,248 A | | 12/1993 | Lee | |
| 5,651,328 A | * | 7/1997 | Elkington | 114/345 |
| 5,743,203 A | | 4/1998 | McNamara | |
| 5,870,965 A | | 2/1999 | Hansen | |
| 5,878,685 A | | 3/1999 | Hemphill et al. | |
| 6,155,192 A | | 12/2000 | Yamaguchi | |

FOREIGN PATENT DOCUMENTS

| | | |
|---|---|---|
| FR | 2114448 | 6/1972 |
| GB | 2196717 | 5/1988 |
| NL | 8102833 | 1/1983 |

* cited by examiner

*Primary Examiner*—Stephen Avila
(74) *Attorney, Agent, or Firm*—Dean W. Russell; Kilpatrick Stockton LLP

(57) ABSTRACT

Alternative collar assemblies for use with watercraft including rigid-hulled boats are described. The collars may include both foam materials and one or more inflatable compartments, thereby offering multiple advantages over existing foam or inflatable collars. Optionally included in or on the collars are reinforcing material (such as but not limited to Kevlar) and an abrasion-resistant coating surrounding the foam and inflatable compartments.

19 Claims, 1 Drawing Sheet

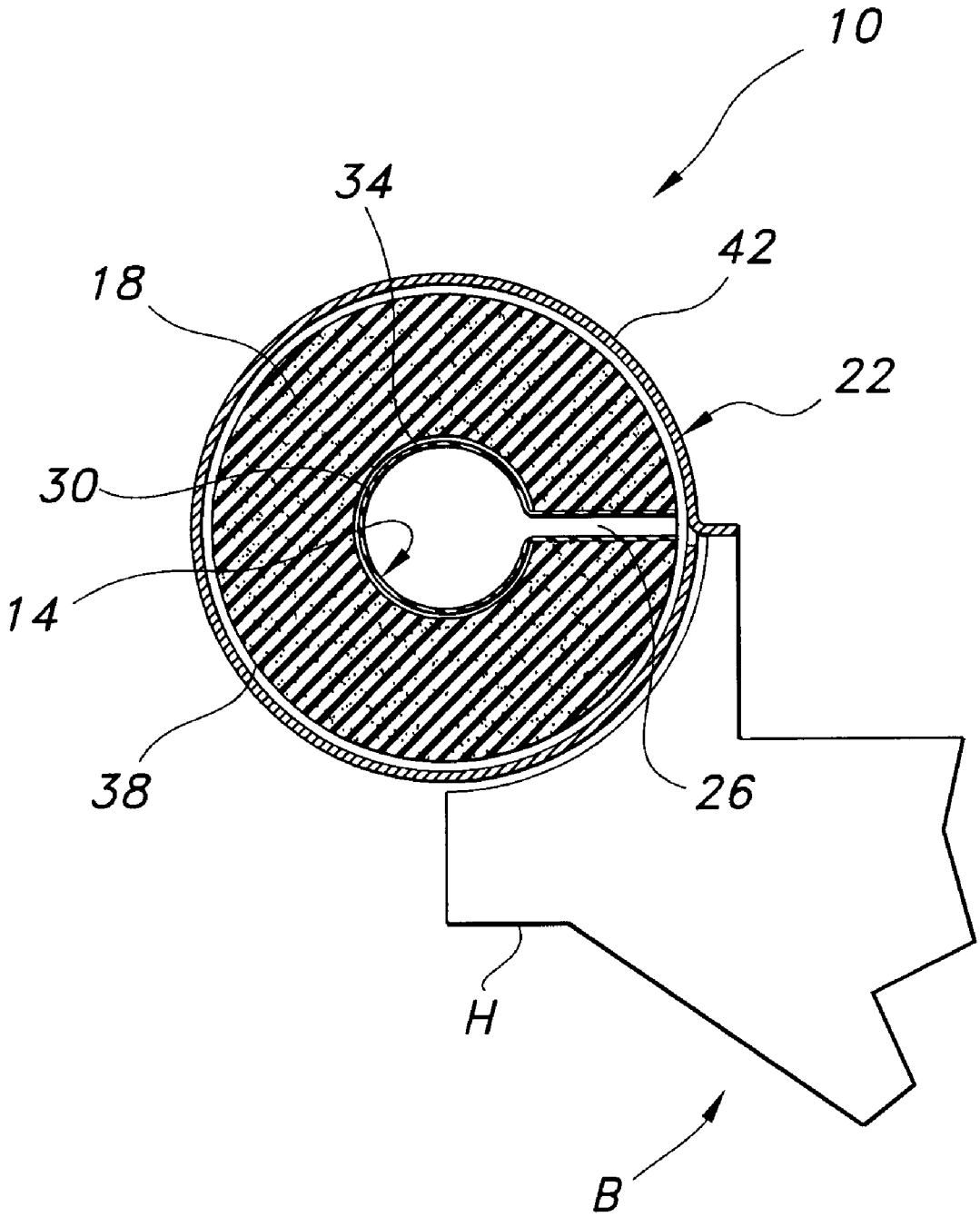
FIGURE

COMBINED FOAM AND INFLATABLE COLLAR ASSEMBLIES FOR WATERCRAFT

REFERENCE TO PROVISIONAL APPLICATION

This application is based on and hereby refers to U.S. Provisional Patent Application Serial No. 60/186,305, filed Mar. 2, 2000, having the same title as appears above.

FIELD OF THE INVENTION

This invention relates to collars and associated components useful in conjunction with watercraft and more particularly to collars adapted to include both foam and inflatable compartments for, among other things, enhanced durability.

BACKGROUND OF THE INVENTION

U.S. Pat. No. 5,878,685 to Hemphill, et al., incorporated herein in its entirety by this reference, illustrates and details various foam collars designed to be affixed to the external surfaces of boat hulls. These collars typically include laminates of closed-cell foams such as (but not necessarily limited to) cross-linked polyethylene-ethylene vinyl-acetate copolymers. Also disclosed in the Hemphill patent are reinforcement coatings (such as polyurethane), which may be adhered to the foam laminates for added abrasion resistance or strength.

U.S. Pat. No. 5,870,965 to Hansen, also incorporated herein in its entirety by this reference, describes boats having foam members mounted to rigid hulls. The foam members are denominated "stabilizers" in the Hansen patent, since they purportedly "act as a running surface when a sharp turn is performed at high speed" in an associated boat. See Hansen, col. 2, 11. 38–39. Likewise, the foam members detailed in the Hansen patent supposedly enhance the righting moment of a hull by "contact[ing] and displac [ing] an increasing volume of water as the boat lists." See id. at 11. 59–61.

According to the Hansen patent, the stabilizing members disclosed therein:

> can be formed of any suitable buoyant foam which can withstand the harsh environment encountered by a high speed watercraft including normal docking and moorage bumping. It is also advantageous that the stabilizing members be formed from a foam that does not absorb water and has some memory. In the preferred embodiment . . . , a closed cell polypropylene or polyethylene foam . . . is used to form the stabilizing members . . . .
>
> . . . In order to increase damage tolerance, it may also be beneficial to coat or cover the exterior of the stabilizing members with a protective material, such as a rubber, liquid vinyl or some other plastic material.

Id. at col. 6, 11. 1–17. Such stabilizing members are expressly contrasted with inflatable tubes, with the latter decried as subject to undesired deflation and requiring availability of a pump. See id. at 11. 18–25. Additionally, although Kevlar is listed as a material from which the hull can be made, see id. at col. 3, 11. 28–29, as noted above only rubber, liquid vinyl, and "other plastic" material are recited as the substances from which a protective coat or cover for the members may be made.

SUMMARY OF THE INVENTION

The present invention provides alternative collar assemblies for use with watercraft including rigid-hulled boats.

Unlike the foam members of the Hansen patent, the collars of the invention are not true "stabilizers" (although they arguably may add stability in certain situations). Instead, they function substantially as fenders, like the collars of the Hemphill patent.

Additionally unlike the stabilizers of the Hansen patent, the foam collars described herein include both foam materials and one or more inflatable compartments. They thus in some senses are composites, offering multiple advantages over existing collars by virtue of incorporating both inflatable material and foam. Yet further benefits may be obtained through use, consistent with the present invention, of reinforcing material (such as but not limited to Kevlar) and an abrasion-resistant coating surrounding the foam and inflatable compartments.

In some embodiments of the innovative collars, an elongated, inflatable bladder is positioned within and substantially circumscribed by a hollow foam tube. In turn, portions of the foam tube are covered by a sleeve-like reinforcing material and the material may be coated or covered with an abrasion-resistant layer. Thus, when the bladder is inflated, it tends to force the foam tube against the sleeve of reinforcing material, facilitating a close, relatively uniform fit. As well, this inflation tensions the sleeve, enhancing energy absorption of the collar and reducing the likelihood that irregularities in the outer surface of the sleeve will cause damage to it.

It therefore is an object of the present invention to provide innovative collars or similar components of, typically, watercraft.

It is another object of the present invention to provide collars including both foam materials and inflatable compartments.

It is an additional object of the present invention to provide collars incorporating therein or thereon either or both of a reinforcing material and an abrasion-resistant coating.

Other objects, features, and advantages of the present invention will be apparent to those skilled in the relevant art with reference to the remaining text and the drawings of this application.

BRIEF DESCRIPTION OF THE DRAWING

The FIGURE is a cross-sectional view of a collar assembly of the present invention shown attached to a boat.

DETAILED DESCRIPTION

Illustrated in the FIGURE is collar assembly 10. Assembly 10 typically is designed to be tubular, with the FIGURE showing its generally-circular cross-section. Assembly 10 need not be tubular, however, but rather may be shaped in any manner consistent with any of the objectives of the present invention. As but one example of an alternatively-shaped structure, assembly 10 may have an elliptical cross-section instead.

Collar assembly 10 additionally is designed for attachment to hull H of a watercraft such as boat B. Acting as a fender for the boat B, in some instances assembly 10 preferably is mounted to hull H sufficiently above the static waterline as to remain above the surface of the water during normal boating operations. In other instances, assembly 10 may be mounted so as to contact the water surface during normal operations. If made of buoyant materials (as is typical) assembly 10 can, of course, provide buoyancy to hull H.

Assembly 10 can be bolted or otherwise mounted, affixed, or attached to hull H in any suitable way. As detailed in the FIGURE, embodiments of assembly 10 may comprise bladder 14, foam material 18, and sleeve 22. Additionally optionally included in assembly 10 may be a reinforcing material made, in part, of aramid or other fibers such as, but not limited to, materials manufactured under the trademark Kevlar. If present, the reinforcing material typically would be positioned intermediate sleeve 22 and foam material 18 in order to protect both the foam material 18 and bladder 14.

Usually (although not necessarily) centrally located radially within assembly 10, elongated bladder 14 is designed to be inflated with air or other suitable fluid. Accordingly, bladder 10 may connect to hose 26 or other ancillary equipment (e.g. a valving mechanism) to enable it to be inflated (and, if appropriate, deflated) after assembly 10 is formed. As well, bladder 14 may be made of any material adapted to retain whatever inflation fluid is used, including Hypalon and other air-holding materials conventionally used for standard inflatable marine collars.

Surrounding substantially all of bladder 14 in some embodiments of assembly 10 is foam material 18. Typically tubular with a hollow core (as detailed in the FIGURE), material 18 may be made of EVA, PVC, or any appropriate foam, although polyethylene presently is preferred. Such foam preferably is closed cell, however, to minimize the likelihood of its absorbing water should the surface of sleeve 22 be penetrated or breached.

Foam material 18 additionally may include one or more channels to permit hose 26 or other inflation-related equipment to be accessible outside assembly 10. Likewise, foam material 18 need not always surround substantially all of bladder 14, although its doing so usually will be advantageous, particularly in preventing penetration of bladder 14 by a foreign object outside boat B. Alternatively, foam material 18 may achieve this objective by surrounding at least the portions of bladder 14—typically those furthest from hull H—most likely to encounter a foreign object.

Detailed also in the FIGURE is covering or sleeve 22 designed to envelope some or substantially all of foam material 18. One embodiment of sleeve 22 comprises fabric coated with polyurethane; unlike some existing foam collar assemblies, therefore, the foam material itself need not be coated. As a result, potential delamination of the foam and coating can be avoided. Additionally, so coating sleeve 22 assists it in resisting damage, particularly from abrasion, when boat B is docked or in use. Other embodiments of sleeve 22 may be uncoated or coated with coatings other than polyurethane, such coatings including but not being limited to Hypalon and PVC.

For added strength and damage resistance for assembly 10, a layer of relatively-flexible fibrous material may be included, typically intermediate sleeve 22 and foam material 18. One such flexible material may be a layer of Kevlar. In addition to providing enhanced strength, the layer may also inhibit projectiles from penetrating assembly 10 sufficient to deflate bladder 14.

Because foam material 18 surrounds some or substantially all of bladder 14, inflating bladder 14 forces its outer wall 30 against the inner core 34 of material 18. Similarly, because foam material 18 is only partially deformable, inflating bladder 14 forces the outer surface 38 of material 18 against sleeve 22 (or any intermediate reinforcing material), thus effectively tensioning assembly 10. This tensioning itself is advantageous, not only permitting the exterior surface 42 of sleeve 22 to be more uniform in appearance, but also likely reducing the opportunity for any slack in sleeve 22 to be snagged or caught (and thereby damaged). By contrast, merely deflating bladder 14 can de-tension assembly 10, facilitating removal of either or both of material 18 and bladder 14 from within sleeve 22 for replacement or repair.

Those skilled in the art will recognize that multiple assemblies 10 may be used in connection with a single boat B and that multiple bladders 14 (or other inflatable compartments) may exist within a single assembly 10. More than one foam material 18 similarly may be utilized as part of assembly 10, and sleeve 22 may be sectioned or configured differently than as shown in the FIGURE (and indeed may be a simple cover or coating rather than a sleeve). Yet additionally, for example, foam material 18 need not have an annular cross-section, and neither bladder 14 nor core 34 need have a circular cross-section.

Thus, although the foregoing is provided for purposes of illustrating, explaining, and describing embodiments of the present invention, numerous modifications and adaptations to these embodiments will be apparent to those skilled in the art and may be made without departing from the scope or spirit of the invention. Generally, in fact, any appropriate assembly combining attributes of foam and inflatable compartments could in certain cases satisfactorily achieve at least some aspects of the present invention.

What is claimed is:

1. A structure for enhancing the buoyancy of a watercraft, comprising:

a. an inflatable bladder;

b. foam material at least partially surrounding the inflatable bladder; and c. a cover at least partially surrounding the foam material; and the structure configured so that inflating the inflatable bladder forces the foam material against the cover.

2. A structure according to claim 1 in which the foam material (i) is closed cell and (ii) substantially circumscribes the inflatable bladder.

3. A structure according to claim 1 in which the cover comprises a sleeve.

4. A structure according to claim 3 further comprising a reinforcing material intermediate the foam material and sleeve.

5. A structure according to claim 4 in which the reinforcing material is fibrous.

6. A structure according to claim 4 in which the reinforcing material comprises aramid fibers.

7. A structure according to claim 3 configured so that inflating the inflatable bladder forces the foam material against the sleeve.

8. A structure according to claim 3 in which the sleeve comprises a fabric coated with polyurethane.

9. A structure according to claim 1 in which the inflatable bladder is tubular.

10. A structure according to claim 9 in which the foam material is tubular and closed cell and substantially circumscribes the inflatable bladder.

11. A structure for enhancing the buoyancy of a watercraft, comprising:

a. an inflatable bladder;

b. foam material at least partially surrounding the inflatable bladder;

c. a cover at least partially surrounding the foam material and having an exterior; and d. an abrasion-resistant layer about the exterior of the cover.

12. A structure according to claim 11 in which the cover comprises a sleeve, further comprising a reinforcing material intermediate the foam material and sleeve.

13. A structure for enhancing the buoyancy of a watercraft, comprising:

a. an inflatable bladder;

b. closed-cell foam material substantially circumscribing the inflatable bladder;

c. a fabric sleeve having an exterior and at least partially surrounding the foam material;

d. a reinforcing material comprising aramid fibers intermediate the foam material and fabric sleeve; and e. an abrasion-resistant layer about the exterior of the sleeve.

14. A watercraft comprising:

a. a hull defining an exterior surface; and b. a buoyancy-enhancing structure mounted to the exterior surface of the hull and comprising:

i. an inflatable bladder comprising a first portion adjacent the exterior surface and a second portion extending away from the exterior surface; and ii. foam material at least partially surrounding the second portion.

15. A watercraft according to claim 14 in which the buoyancy-enhancing structure comprises a plurality of inflatable bladders.

16. A watercraft according to claim 15 in which foam material at least partially surrounds each of the plurality of inflatable bladders.

17. A watercraft according to claim 14 further comprising a cover at least partially surrounding the foam material.

18. A watercraft according to claim 17 configured so that inflating the inflatable bladder forces the foam material against the cover.

19. A watercraft according to claim 18 in which the cover comprises a sleeve and inflating the bladder forces the foam material against the sleeve.

* * * * *